US009896163B2

(12) United States Patent
Lewis

(10) Patent No.: US 9,896,163 B2
(45) Date of Patent: Feb. 20, 2018

(54) FOOTING FOR BOAT COVER SUPPORT

(76) Inventor: William James Lewis, Woodstock, IL (US)

( * ) Notice: Subject to any disclaimer, the term of this patent is extended or adjusted under 35 U.S.C. 154(b) by 807 days.

(21) Appl. No.: 13/253,122

(22) Filed: Oct. 5, 2011

(65) Prior Publication Data

US 2012/0085880 A1 Apr. 12, 2012

Related U.S. Application Data

(60) Provisional application No. 61/390,704, filed on Oct. 7, 2010.

(51) Int. Cl.
*F16M 13/00* (2006.01)
*B63B 17/00* (2006.01)
*B63B 17/02* (2006.01)

(52) U.S. Cl.
CPC ..... *B63B 17/00* (2013.01); *B63B 17/02* (2013.01)

(58) Field of Classification Search
USPC ..... 248/511, 519, 523, 518, 346.01, 520, 248/507, 346.03, 188.9, 357, 127, 160, 248/174, 188.1, 910; 52/298–299; 40/607.1; 135/116, 16, 99, 114
See application file for complete search history.

(56) References Cited

U.S. PATENT DOCUMENTS 2,424,818 A * 7/1947 Gustafson ..... A47G 33/12 248/523
2,514,109 A * 7/1950 Walsh ..... A47B 91/08 248/158
3,106,931 A * 10/1963 Cooper ..... B63B 17/04 114/361
3,415,475 A * 12/1968 Goodman ..... F16M 11/22 248/158
4,642,931 A * 2/1987 Flores ..... A01K 97/10 248/156
4,889,067 A * 12/1989 Provence, Jr. ..... E01F 9/688 116/63 C
5,141,076 A * 8/1992 Joyce ..... E06C 7/46 182/108
5,337,989 A * 8/1994 Apple ..... E04H 12/2238 248/222.13
5,427,342 A * 6/1995 Gagnon ..... A47B 91/00 182/108
5,441,066 A * 8/1995 Harris ..... B63B 17/02 135/88.01
5,685,107 A * 11/1997 Sweet ..... A01K 97/10 43/21.2
5,746,031 A * 5/1998 Burns ..... A62C 2/00 248/519
5,755,419 A * 5/1998 Gearhart ..... A63H 27/10 248/176.1
5,901,525 A * 5/1999 Doeringer ..... E02D 27/42 248/519

(Continued)

OTHER PUBLICATIONS

Overton's, Inc., "Overton's 2010 Master Catalog," published prior to Jun. 3, 2010, pp. 122-123 (4 pages).

*Primary Examiner* — Christopher Garft
(74) *Attorney, Agent, or Firm* — Pauley Erickson & Kottis

(57) ABSTRACT

A footing for a support, such as a pole. The footing includes a generally flat and flexible base, a support receiver formed on the base, and a slit through the base and extending inwardly toward the support receiver from an outer edge of the base.

20 Claims, 2 Drawing Sheets

(56) References Cited

U.S. PATENT DOCUMENTS 6,202,369 B1 * 3/2001 Partee ..... E04H 12/2269 248/523
6,206,613 B1 * 3/2001 Elkins ..... F16L 3/02 248/49
D475,995 S * 6/2003 Hsieh ..... D14/229
6,619,610 B1 * 9/2003 Genovese ..... E04H 12/2246 135/118
6,669,160 B2 * 12/2003 Steinmetz ..... G01K 11/28 248/346.01
D485,743 S * 1/2004 Wilson, Sr. ..... D8/354
6,682,055 B1 * 1/2004 Tomlinson ..... E01F 13/022 248/129
7,195,222 B2 * 3/2007 Dent ..... E01F 9/635 248/511
7,780,139 B2 * 8/2010 Markert ..... E04H 12/2261 135/15.1
7,878,478 B2 * 2/2011 Gumm ..... E04H 12/2238 135/121
7,930,859 B1 * 4/2011 Eslambolchi ..... E04H 12/2269 248/159
D637,877 S * 5/2011 Elkins ..... D8/44
8,096,310 B2 * 1/2012 Clarke ..... A45B 25/02 135/16
8,251,337 B2 * 8/2012 Jordan ..... A47G 33/12 248/519
8,505,861 B2 * 8/2013 Carnevali ..... B60R 11/02 248/188.7
2002/0040956 A1 * 4/2002 Carnahan ..... B63B 329/06 248/188.8
2003/0146360 A1 * 8/2003 Steinmetz ..... G01K 11/28 248/346.01
2004/0031902 A1 * 2/2004 Davis, Jr. ..... F16M 7/00 248/519
2012/0211629 A1 * 8/2012 Shaw ..... A47G 23/0216 248/346.03

* cited by examiner

FOOTING FOR BOAT COVER SUPPORT

CROSS REFERENCE TO RELATED APPLICATION

This application claims the benefit of U.S. Provisional Patent Application, Ser. No. 61/390,704, filed on 7 Oct. 2010. The Provisional Patent Application is hereby incorporated by reference herein in its entirety and is made a part hereof, including but not limited to those portions which specifically appear hereinafter.

BACKGROUND OF THE INVENTION

This invention relates generally to a footing for a support and, more particularly, to a support footing for a pole for holding up a tarp or cover, such as for a boat.

Boat tarps are used to protect boats from sun, rain, and animals between boat uses. The tarps are typically secured around the sides of the boat and tented in the middle through the use of one or more pole structures. One end of the pole sits on the boat deck and the opposing end lifts the boat tarp into a raised, tented position. The ends of the metal poles are often covered by simple rubber or plastic caps. While the caps protect the boat and/or tarp from the metal pole edges, poles are know to fall, such as due to wind impacting the tarp, leading to collection of water within the tarp and/or boat itself. Several mechanisms have been developed to connect, or otherwise limit slip of, the pole support with the tarp. There is an ongoing need for an improved base that holds the pole in position on the boat deck.

SUMMARY OF THE INVENTION

The invention provides a footing structure for a support, such as a pole. The footing and the support are especially suited for use in supporting boat tarps, but are not intended to be so limited. The footing structure of this invention can be used with support structures of various size, shape, and function, such as with supports for tents or in other non-skid applications.

The general object of the invention can be attained, at least in part, through a footing for a support, comprising a base, a support receiver connected to the base, and a slit extending inwardly from an outer edge of the base. The base has an outer periphery, and the support receiver is positioned on the base within the outer periphery, such as centrally located, and the slit inwardly extends from the outer periphery, such as toward the support receiver.

The base and support receiver can be formed of a rigid polymer or other material, but is desirably formed of a flexible polymer material. Exemplary polymers include, without limitation, nylon, thermoplastic elastomers, polyolefins, polyurethane, thermoplastic vulcanizate, acrylonitrile-butadiene-styrene, plastomers, polylactic acid, ploycarbonate, polyester, polyetherimide, polyethylene, polyphenylene ether, polyphthalamide, polypropylene, polystyrene, polysulfone, polyvinyl chloride, styrene-butadiene copolymer, polystyrene, silicone rubber, liquid silicone rubber, and combination thereof. The base and the support receiver can be integrally formed, such as molded as one piece from the same material.

The support receiver can include a recessed cup for receiving an end of the support pole. A rigid protective element can be disposed at the bottom of the recessed cup, such as to protect a softer, flexible material base from the end of the pole.

The recessed cup can include a recess in an inner wall of the recessed cup, wherein at least a portion of an edge of the protective element is disposed within the recess.

The slit can be radially positioned with respect to the base center and/or the support receiver. The slit desirably does not contact or intersect the support receiver, and can extend from the outer edge of the base a length of more than 25% of a radius of the base, and desirably a length of more than 50% of a radius of the base.

Other objects and advantages will be apparent to those skilled in the art from the following detailed description taken in conjunction with the included drawings, and the description thereof.

DETAILED DESCRIPTION OF THE INVENTION

The present invention provides a footing for a support, such as a support pole. The invention is described below with reference to a preferred use for supporting boat tarps, but is not intended to be so limited. The footing can be used with supports for other functions, such as tent poles, or covers for other vehicles. The footing of the invention can also be used to provide non-slip feet for items, such as tables, chairs, or other accessories.

Figure 1:
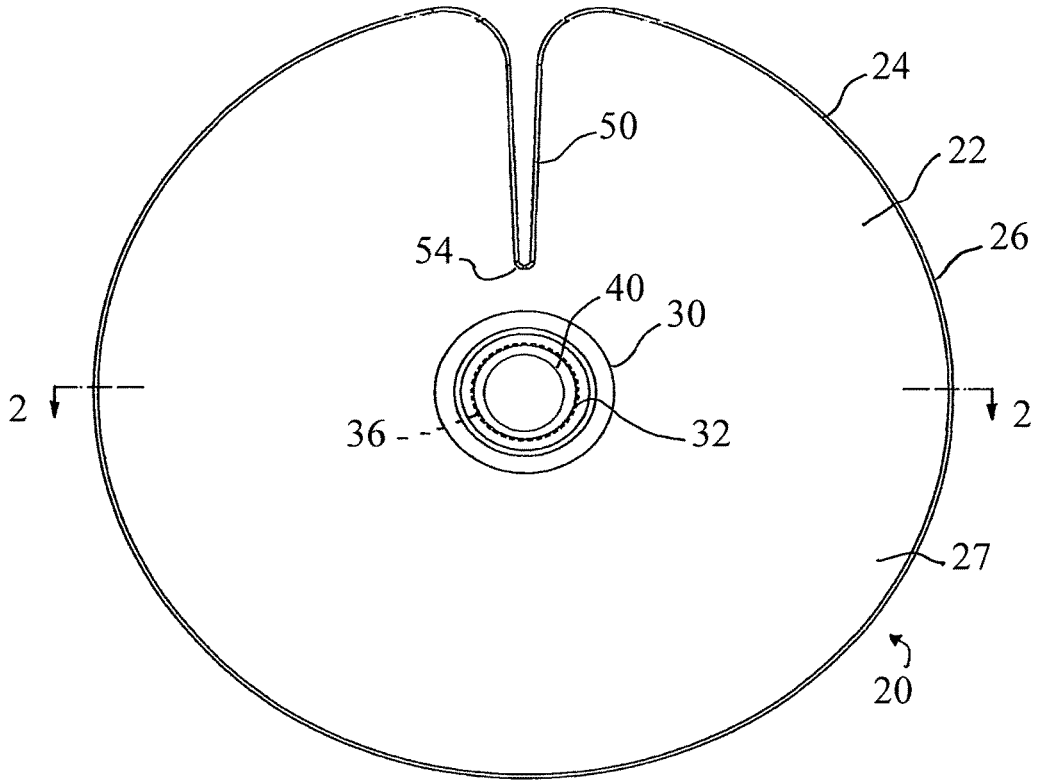
FIG. 1 is a top view of a footing according to one embodiment of this invention.
Figure 2:
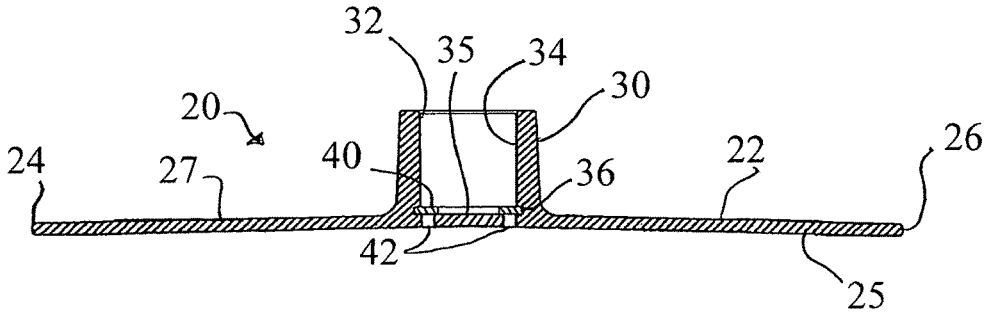
FIG. 2 is a sectional view of the footing according to FIG. 1

FIGS. 1 and 2 include a footing 20 according to one embodiment of this invention. The footing 20 includes a base 22 having an outer periphery 24 defined generally by outer edge 26. The base 22 has a generally flat and/or planar bottom surface 25 and a parallel top surface 27. Alternatively, the bottom surface can have a slight concave or rounded configuration, which can prevent cupping of the flexible base and/or provide suction on a flat surface. The bottom surface 25 can be generally smooth as shown, or include any known texture, such as for providing grip.

Various and alternative sizes, shapes, thicknesses, and configurations are available for the base according to this invention. In the embodiment of FIGS. 1 and 2, the base 22 is generally circular, but could be other shapes including, without limitation, square, rectangular, oval, ovoid, triangular, or complex combinations of shapes, including symmetrical or asymmetrical configurations, depending on need. The diameter and thickness of the base can also vary depending on need. In one embodiment of the invention, the base has a diameter of about 3 to about 18 inches, more desirably about 6 to about 12 inches, and preferably about 8 to about 10 inches.

The footing includes a support receiver 30 connected to the base. The support receiver 30 functions to attach or otherwise secure the support, e.g., pole, to the base 22. The support receiver 30 is centrally disposed on the base 22, and is desirably integrally formed as one molded piece with the base 22. Various and alternative sizes, shapes, and configurations are available for the support receiver, depending on need and the size, shape, and configuration of the pole to be supported. For example, the support receiver can include a female element or male element, for receiving or inserting, respectively, into a pole, and the support receiver can be threaded to coordinate with a threaded pole.

In one embodiment of this invention, as shown in FIGS. 1 and 2, the support receiver 30 includes a recessed cup 32 for receiving an end of a pole. The recessed cup 32 includes an inner wall 34 that extends down toward a bottom end 35 of the cup 32, which in this embodiment is the top surface 27 of the base 22. The recessed cup 32, and particularly the inner wall 34, has a tubular configuration corresponding to a tubular shape of a pole to be fit therein. Desirably the recessed cup 32 will have an inner diameter equal to or slightly less than the outer diameter of the pole, thereby providing a friction fit to secure the pole to the footing 20.

In one embodiment of this invention, the support 20 includes a protective element 40 disposed within the recessed cup 32. The protective element 40 provides a protective layer between the material of the bottom end of the recessed cup 32 and the pole end, to reduce or eliminate wear on the footing 20 from the metal pole end. The protective element 40 is desirably a rigid material, such as hard plastic or metal. As shown in FIGS. 1 and 2, the protective element 40 can be embodied as a metal circle or washer pressed or molded into the recessed cup 32 after molding the footing 20.

In one embodiment of this invention, the recessed cup 32 includes a recessed groove 36 in the inner wall 34 of the recessed cup. The groove 36 desirably encircles the bottom surface of recessed cup 32. A portion of the edge of the protective element 40 is disposed within the groove 36, thereby securing the protective element 40 in place. In the particular embodiment as shown in FIG. 2, the placement of the protective element 40 has an added benefit of covering molding holes 42, which can result due to injection molding techniques.

The base 22 and support receiver 32 can be formed separately and attached together, such as by mechanical or adhesive attachment, but are desirably integrally formed as one-piece, such as through plastic molding techniques. The base 22 and the support receiver 32 can be formed of various materials, including rigid and/or flexible polymers. Exemplary polymers include, without limitation, nylon, thermoplastic elastomers, polyolefins, polyurethane, thermoplastic vulcanizate, acrylonitrile-butadiene-styrene, plastomers, polylactic acid, ploycarbonate, polyester, polyetherimide, polyethylene, polyphenylene ether, polyphthalamide, polypropylene, polystyrene, polysulfone, polyvinyl chloride, styrene-butadiene copolymer, polystyrene, silicone rubber, liquid silicone rubber, and combination thereof. Various fillers or colorants can optionally be added as desired and/or depending on need for functional and/or decorative purposes.

The footing 20 can desirably be molded from a flexible polymer material. In one embodiment of this invention, the flexible polymer material desirably has a Shore A hardness of up to about 80, and desirably about 20 to 60. The flexible polymer material of one embodiment of this invention also desirably has a higher coefficient of friction, such as at least 0.30, desirably about or greater than about 0.50, more desirably about or greater than about 0.75, and more desirably about or greater than 1.0, with materials such as plastic, fiberglass, metal, and/or gelcoat (e.g., epoxy or polyester resin) surfaces, thereby providing additional non-slip grip with the underlying surface. Forming the footing from a flexible material also can provide additional grip to the underlying surface due to vacuum forces between the flexible base and underlying surface. Providing a slightly pre-curved, concave, or domed structure for the base instead of a planar structure can also provided increased vacuum force grip.

The footing 20 further includes a slit 50 extending within the base 22, from a top surface 27 to a bottom surface 25. The slit 50 is disposed radially with respect to the support receiver 32, but desirably is not in contact with the support receiver 32. As shown in FIG. 1, the slit 50 extends from the outer periphery 24 of the base 22 toward, and stopping short of, the support receiver 32, thereby providing a "lilly pad" configuration. Various sizes, shapes, numbers, and configurations are available for the slit in the base of this invention. In one embodiment of this invention, the slit has a length of more than 25% of a radius of the base 22, and desirably a length of more than 50% of a radius of the base 22, such as at or more than about 75% of a radius of the base 22. In another embodiment, the slit 50 tapers from the outer periphery to an end 54, at which the slit 50 has a width of about 0.01 to about 0.25 inch, and more desirably from about 0.06 to about 0.13 inch. The slit 50 allows for additional functionality and flexibility during use. For example, the slit allows the footing 20 to be placed closer to objects on the surface, such as boat sidewalls, seats, motor boxes, or surface variations, by allowing the base 22 to lift on one side. More than one slit can be used to further promote this benefit. The slit 50 also can facilitate releasing any vacuum grip on the underlying surface, such as by tilting or pulling the pole in a direction toward the slit 50. The slit 50 can also provide the base with a bending ability that allows the footing 20 to be additionally or alternatively used at the top end of the support pole, in contact with the boat tarp.

Figure 3:
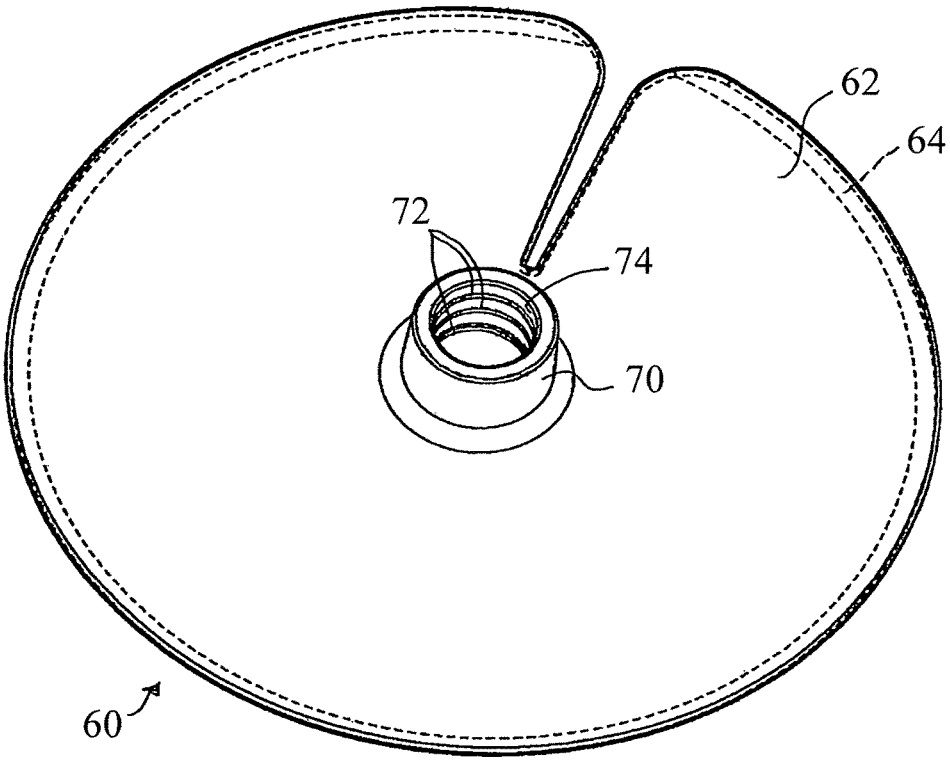
FIG. 3 is a perspective view of a footing according to another embodiment of this invention.

FIG. 3 shows a footing 60 according to another embodiment of this invention. The footing 60 has a base 62 and support receiver 70 having the general configuration discussed above, plus additional and optional features. For example the base 62 includes a circumferential ridge 64 extending downward from the bottom surface and adjacent the outer periphery 66 of the base 62. The support receiver 70 includes a plurality of inwardly oriented, parallel ribs 72 extending from the inner surface 74. One or more of the ribs 72 can be provided to increase the grip on the pole end within the support receiver 70.

The invention provides an economical, adaptable footing for a support pole. The footing is easily molded and attachable to a support pole to provide a stable grip to surfaces such as fiberglass floors of boats. The footing can be made from a flexible, non-marking material that can adapt to variations in the underlying surface, while still providing a friction grip to the surface.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A footing for a boat cover support pole, comprising:

a base having an outer periphery and a top surface, the base formed of a flexible polymer material;

a support receiver connected to and extending above the top surface of the base within the outer periphery; and the base including a slit extending from the outer periphery toward the support receiver, wherein the base is adapted to be set upon a surface of a boat and the support receiver is adapted to receive a boat cover pole.

2. The footing of claim 1, wherein the base and the support receiver are integrally formed.

3. The footing of claim 2, wherein the support receiver is formed of the flexible polymer material.

4. The footing of claim 3, wherein the flexible polymer has a Shore A hardness of about 80 or less.

5. The footing of claim 3, wherein the flexible polymer has a coefficient of friction of at least 0.30 with a fiberglass, metal, or gelcoat surface.

6. The footing of claim 1, wherein the support receiver comprises a recessed cup for receiving an end of the support.

7. The footing of claim 6, further comprising a rigid protective element at a bottom of the recessed cup, wherein during use the protective member is disposed between an end of the boat cover support pole and the flexible polymer base.

8. The footing of claim 7, further comprising a recess in an inner wall of the recessed cup, wherein at least a portion of an edge of the protective element is disposed within the recess.

9. The footing of claim 1, wherein the slit has a length of more than 25% of a radius of the base.

10. The footing of claim 1, wherein the slit has a length of more than 50% of a radius of the base.

11. The footing of claim 1, wherein the base is formed of a material selected from nylon, thermoplastic elastomers, polyolefins, polyurethane, thermoplastic vulcanizate, acrylonitrile-butadiene-styrene, plastomers, polylactic acid, ploycarbonate, polyester, polyetherimide, polyethylene, polyphenylene ether, polyphthalamide, polypropylene, polystyrene, polysulfone, polyvinyl chloride, styrene-butadiene copolymer, polystyrene, and combination thereof.

12. A footing for a boat cover support pole, comprising:

a base having an outer periphery;

a support receiver outwardly extending from one surface of the base within the outer periphery, the support receiver comprising a recessed cup adapted to receive the boat cover support pole;

the base and the support receiver integrally formed from a flexible polymer to form a flexible base adapted to be set upon a surface of a boat; and a slit extending through the base and from the outer periphery toward and stopping short of the support receiver, wherein a first portion of the base on one side of the slit lifts independent of a second portion of the base on a second side of the slit.

13. The footing of claim 12, wherein the flexible polymer has a Shore A hardness of about 80 or less, and a coefficient of friction of at least 0.30 with a fiberglass, metal, or gelcoat surface.

14. The footing of claim 12, further comprising a rigid protective element at a bottom of the recessed cup, wherein during use the protective member is disposed between an end of the boat cover support pole and the flexible polymer base.

15. The footing of claim 14, further comprising a recess in an inner wall of the recessed cup, wherein at least a portion of an edge of the protective element is disposed within the recess.

16. The footing of claim 12, wherein the slit has a length of more than 50% of a radius of the base.

17. The footing of claim 12, wherein the slit has a length of more than 75% of a radius of the base.

18. A footing for a boat cover support pole, comprising:

a generally circular and flexible base formed of a flexible polymer and having an outer periphery and an outwardly extending support receiver at a center of the base, the support receiver comprising a recessed cup adapted to receive the boat cover support pole and including an inner wall, a bottom end, and a recess in the inner wall and adjacent the bottom end;

a rigid protective element disposed within the recessed cup and including at least a portion of an edge disposed within the recess, wherein during use the protective member is disposed between an end of the boat cover support pole and the flexible polymer base; and a slit through the base and extending from the outer periphery toward and stopping short of the support receiver.

19. The footing of claim 18, wherein the flexible polymer has a Shore A hardness of about 80 or less, and a coefficient of friction of at least 0.30 with a fiberglass, metal, or gelcoat surface.

20. The footing of claim 18, wherein the base has a diameter of about 8 to about 12 inches, and the slit comprises a width from 0.06 to about 0.15 inch at an end toward the support receiver.

* * * * *